US006805061B2

(12) United States Patent
Smyers et al.

(10) Patent No.: US 6,805,061 B2
(45) Date of Patent: Oct. 19, 2004

(54) TWO-PIECE PALLET

(75) Inventors: Justin M. Smyers, Redondo Beach, CA (US); Trenton M. Overholt, Manhattan Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 10/054,236

(22) Filed: Jan. 22, 2002

(65) Prior Publication Data

US 2003/0136314 A1 Jul. 24, 2003

(51) Int. Cl.[7] ..... B65D 19/38

(52) U.S. Cl. ..... 108/57.25; 108/57.26; 108/902

(58) Field of Search ..... 108/57.1, 901, 108/56.1, 57.26, 902

(56) References Cited

U.S. PATENT DOCUMENTS

| | | | |
|---|---|---|---|
| 2,544,657 | A | 3/1951 | Cushman |
| 2,699,912 | A | 1/1955 | Cushman |
| 3,126,843 | A | 3/1964 | DeLaney |
| 3,307,504 | A | 3/1967 | Cloyd et al. |
| 3,467,032 | A | 9/1969 | Rowlands et al. |
| 3,602,157 | A | 8/1971 | Cohen et al. |
| 3,651,769 | A | 3/1972 | Foley |
| 3,654,874 | A | 4/1972 | Skinner |
| 3,678,868 | A | 7/1972 | Hirota |
| 3,685,461 | A | 8/1972 | Belcher |
| 3,710,733 | A | 1/1973 | Story |
| D231,096 | S | 4/1974 | Adam |
| D232,019 | S | 7/1974 | Rehrig et al. |
| 3,824,933 | A | 7/1974 | Lind |
| 3,835,792 | A | 9/1974 | Wharton |
| 3,878,796 | A | 4/1975 | Morrison |
| 3,964,400 | A | 6/1976 | Brand |
| 4,051,787 | A | 10/1977 | Nishitani et al. |
| D246,296 | S | 11/1977 | Fujii et al. |
| 4,103,857 | A | 8/1978 | Levenhagen |
| 4,183,491 | A | 1/1980 | Sanders et al. |
| 4,287,836 | A | 9/1981 | Aoki |
| 4,316,419 | A | 2/1982 | Cupido |
| 4,403,555 | A | 9/1983 | Forrest |
| 4,597,338 | A | 7/1986 | Kreeger |
| 5,197,395 | A | 3/1993 | Pigott et al. |
| D346,681 | S | 5/1994 | Pigott et al. |
| D347,511 | S | 5/1994 | Pigott et al. |
| D371,882 | S | 7/1996 | Kristoffersson |
| 5,676,064 | A | 10/1997 | Shuert |
| 5,791,261 | A | 8/1998 | John et al. |
| 5,809,905 | A | 9/1998 | John et al. |
| 5,845,588 | A | 12/1998 | Gronnevik |
| 5,860,369 | A | 1/1999 | John et al. |
| 5,887,529 | A | 3/1999 | John et al. |
| 6,006,677 | A | 12/1999 | Apps et al. |
| 6,029,583 | A | 2/2000 | LeTrudet |
| 6,109,190 | A | 8/2000 | Hale et al. |

FOREIGN PATENT DOCUMENTS

| | | |
|---|---|---|
| DE | 2232200 | 1/1973 |
| DE | 27 33 457 | 2/1979 |

*Primary Examiner*—Jose V. Chen
(74) *Attorney, Agent, or Firm*—Brooks Kushman P.C.

(57) ABSTRACT

A pallet is provided having spaced first and second decks and a plurality of opposed mating areas formed in each of the decks. Each mating area includes alternating projections and recesses, where the projections of the first deck are arranged to be received by the recesses of the second deck and the projections of the second deck are arranged to be received by the recesses of the first deck. Each mating area further includes at least one latch member extending therefrom, where the latch members of one deck are arranged to engage the projections of the other deck such that engagement of the mating areas of the first and second decks securely joins the decks in an assembled configuration.

29 Claims, 12 Drawing Sheets

TWO-PIECE PALLET

BACKGROUND OF THE INVENTION

1. Field of the Invention

This invention relates to pallets for supporting freight, goods, or other materials.

2. Background Art

Plastic pallets typically have separate upper and lower decks which are secured together in some manner, such as by mechanical latches. The separate upper and lower decks each usually have different latching features, requiring the expense of having two separate molds. In addition, impact to the pallet encountered during handling, such as from a fork lift or the like, might possibly cause lateral movement of the upper and lower decks with respect to one another and result in disengagement of the decks. In particular, pallets may be vulnerable to forces applied along the parting line between the upper and lower decks. Therefore, a need exists for a pallet which is more resistant to impact along the parting line and provides a more secure latching feature to enhance the attachment of the upper and lower decks to counter separation of the decks.

SUMMARY OF THE INVENTION

It is an object according to the present invention to provide a pallet having a parting line that is less vulnerable to forces during impact which could cause separation of the upper and lower decks.

It is a further object according to the present invention to provide a pallet which includes more secure latching of the upper and lower decks in the assembled configuration.

It is another object according to the present invention to provide a pallet wherein the upper and lower decks have mating features in addition to the latching mechanism for interlocking the two decks in an assembled configuration.

It is still another object according to the present invention to provide a plastic pallet which is lightweight, strong, durable, and easy to manufacture.

Accordingly, a pallet is provided having spaced first and second decks and a plurality of opposed mating areas formed in each of the decks. Each mating area includes alternating projections and recesses, where the projections of the first deck are arranged to be received by the recesses of the second deck and the projections of the second deck are arranged to be received by the recesses of the first deck. Each mating area further includes at least one latch member extending therefrom, where the latch members of one deck are arranged to engage the projections of the other deck such that engagement of the mating areas of the first and second decks securely joins the decks in an assembled configuration.

In accordance with the present invention, engagement of the projections and recesses results in a non-planar parting line between the assembled first and second decks. The projections and recesses of each deck are tapered to mate with an interference fit, and also include angled faces which engage to restrain transverse movement of the assembled decks. When the decks are in the assembled configuration, corresponding mating areas of the first and second decks include an alternating arrangement of latch members of the first deck engaged with projections of the second deck and latch members of the second deck engaged with projections of the first deck. Furthermore, engagement surfaces defined by the location of engagement of latch members of the first deck and projections of the second deck are not co-planar with engagement surfaces defined by the location of engagement of latch members of the second deck and projections of the first deck.

Each latch member includes an arm portion which projects outwardly from the mating area, a generally horizontal shoulder portion connected to the arm portion, and a tapered end portion connected to the shoulder portion. Correspondingly, each projection includes a receiving face arranged to engage the shoulder portion of one latch member. The latch members are flexible, such that engagement of the opposed mating areas causes the projections to contact the tapered end portions of each latch member and deflect the latch members outwardly from their resting position. Passage of the receiving face past the tapered portion allows the latch members to return to their rest position such that the shoulder portions of the latch members engage the receiving faces of the projections.

The pallet is preferably constructed from a plastic material. According to one embodiment of the present invention, the first and second decks have reversible configurations. Preferably, the upper and lower deck mating areas include corner mating areas disposed in the corner of each deck, medial mating areas disposed at both ends of a longitudinal axis of the pallet, and transverse mating areas disposed along either side of a transverse axis of the pallet. Complementary configurations of projections and recesses exist between adjacent corner mating areas, between the medial mating areas, and between adjacent transverse mating areas on opposite sides of the transverse axis within each deck.

In further accordance with the present invention, a pallet is provided including a lower deck having a plurality of lower deck mating areas, and an upper deck spaced from and overlying the lower deck, the upper deck having a plurality of upper deck mating areas complementary to the lower deck mating areas. Each of the lower deck and upper deck mating areas includes an alternating arrangement of projections and recesses. During assembly of the upper and lower decks, the projections of the lower deck are arranged to be securely received by the recesses of the upper deck and the projections of the upper deck are arranged to be securely received by the recesses of the lower deck, resulting in a non-planar parting line between the upper and lower decks.

According to a preferred embodiment of the present invention, a two-piece plastic pallet is provided which includes spaced upper and lower decks and a plurality of opposed mating areas formed in the upper and lower decks, where each mating area includes alternating projections and recesses and a plurality of latch members extending therefrom. The projections and recesses of each deck include angled faces which engage to restrain transverse movement of the assembled decks. During assembly of the upper and lower decks, engagement of the corresponding upper deck and lower deck mating areas causes the projections of the lower deck to be received by the recesses of the upper deck and the projections of the upper deck to be received by the recesses of the lower deck, resulting in a non-planar parting line between the upper and lower decks. Furthermore, the latch members of one deck are arranged to engage the projections of the other deck such that when the decks are in an assembled configuration, corresponding mating areas of the upper and lower decks include an alternating arrangement of latch members of the upper deck engaged with projections of the lower deck and latch members of the lower deck engaged with projections of the upper deck.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
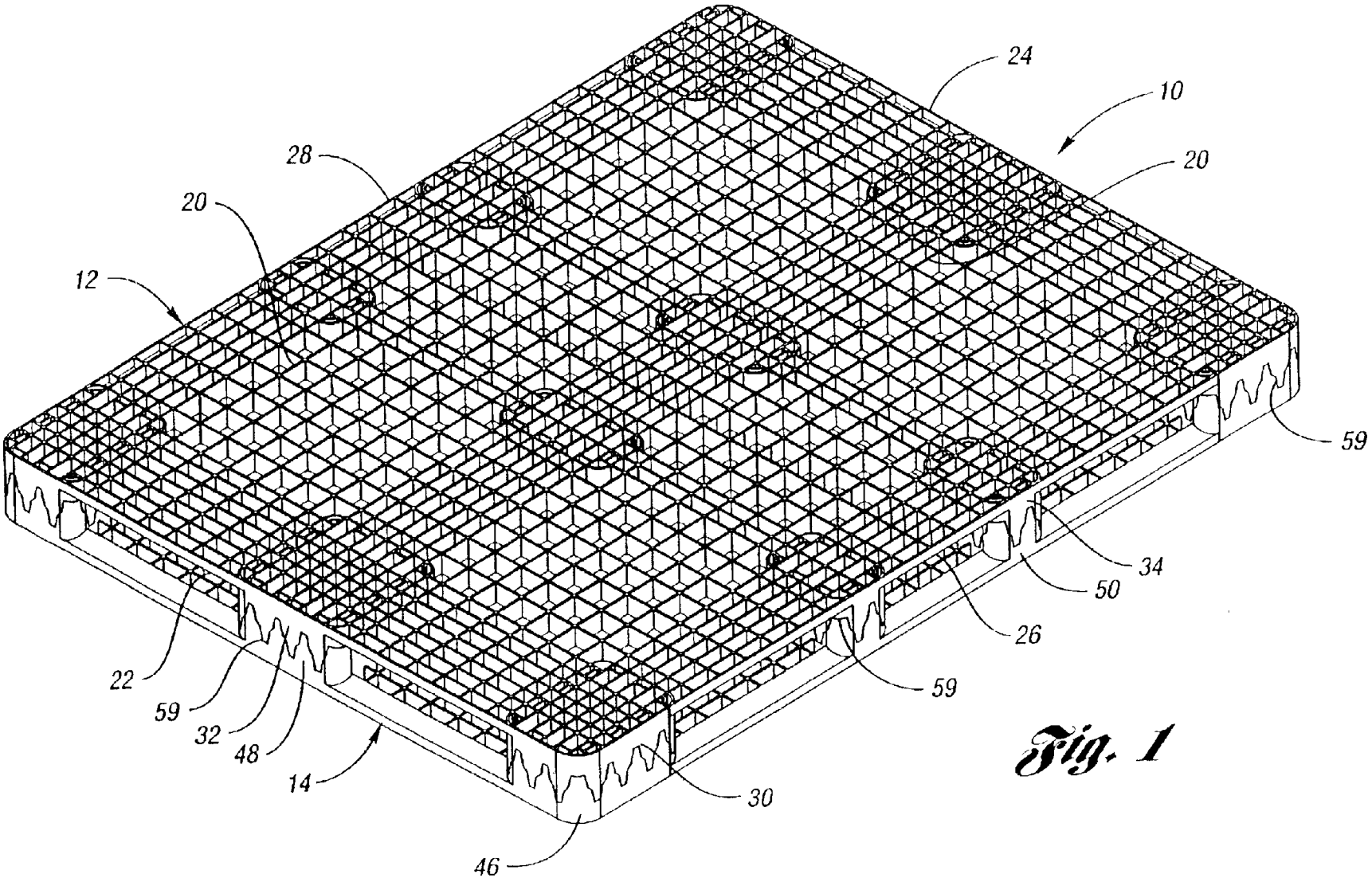
FIG. 1 is a top perspective view of an assembled pallet according to the present invention.

Referring first to FIGS. 1–5, a pallet according to the present invention is illustrated and designated generally by reference numeral 10. Pallet 10 includes two separately molded parts, namely an upper deck 12 and a lower deck 14. Upper deck 12 and lower deck 14 are injection molded of a suitable plastic material, such as polypropylene. In plan view (FIGS. 2–3), pallet 10 is generally rectangular in shape with rounded corners, having a longitudinal axis 16 and a transverse axis 18. The two-piece injection molded plastic construction of pallet 10 affords substantial strength, durability, and ease of assembly. As explained below, upper and lower decks 12, 14 are adapted to be easily snapped together to form the assembled pallet 10 illustrated in FIGS. 1–5.

Figure 2:
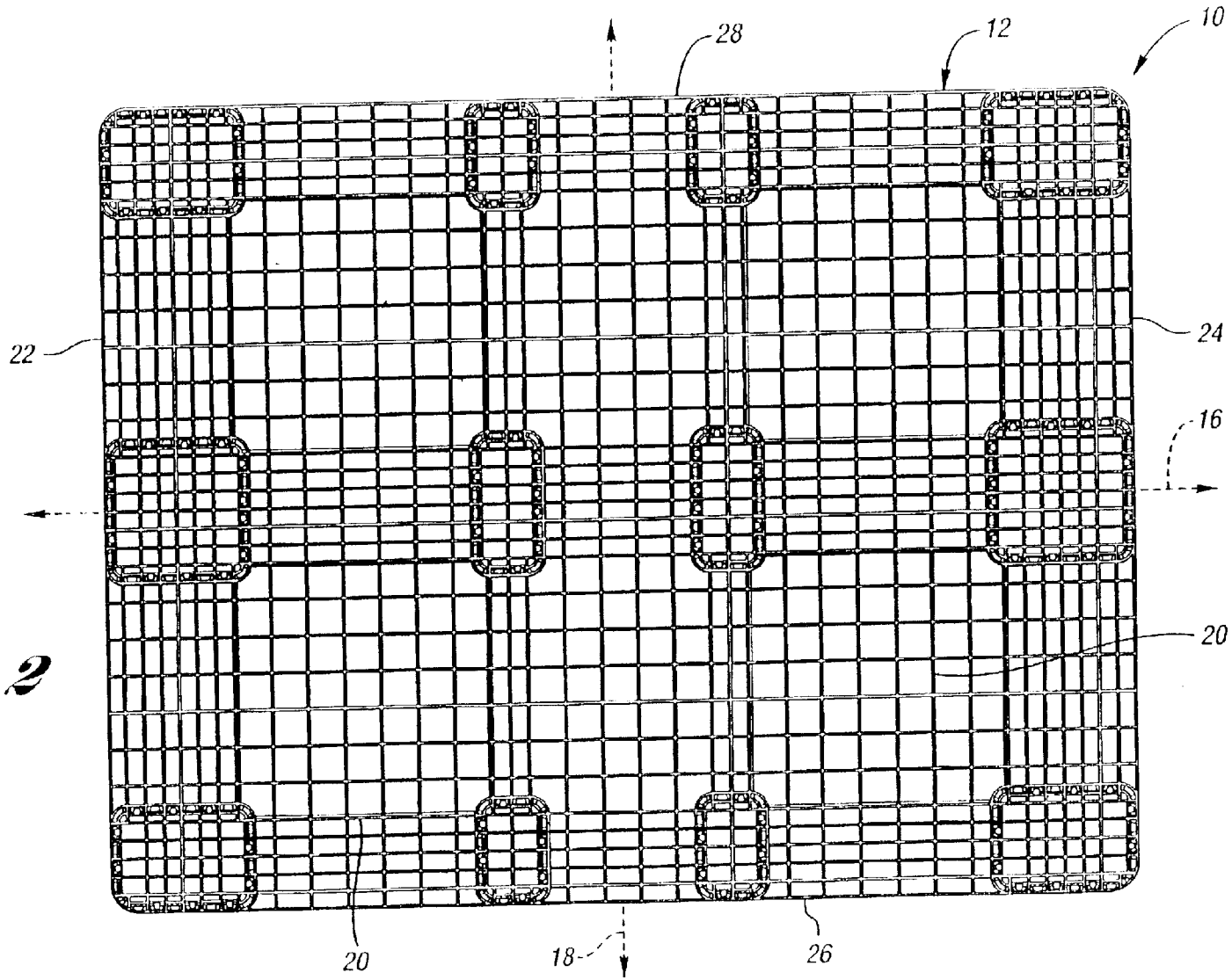
FIG. 2 is top plan view of the pallet of FIG. 1.
Figure 3:
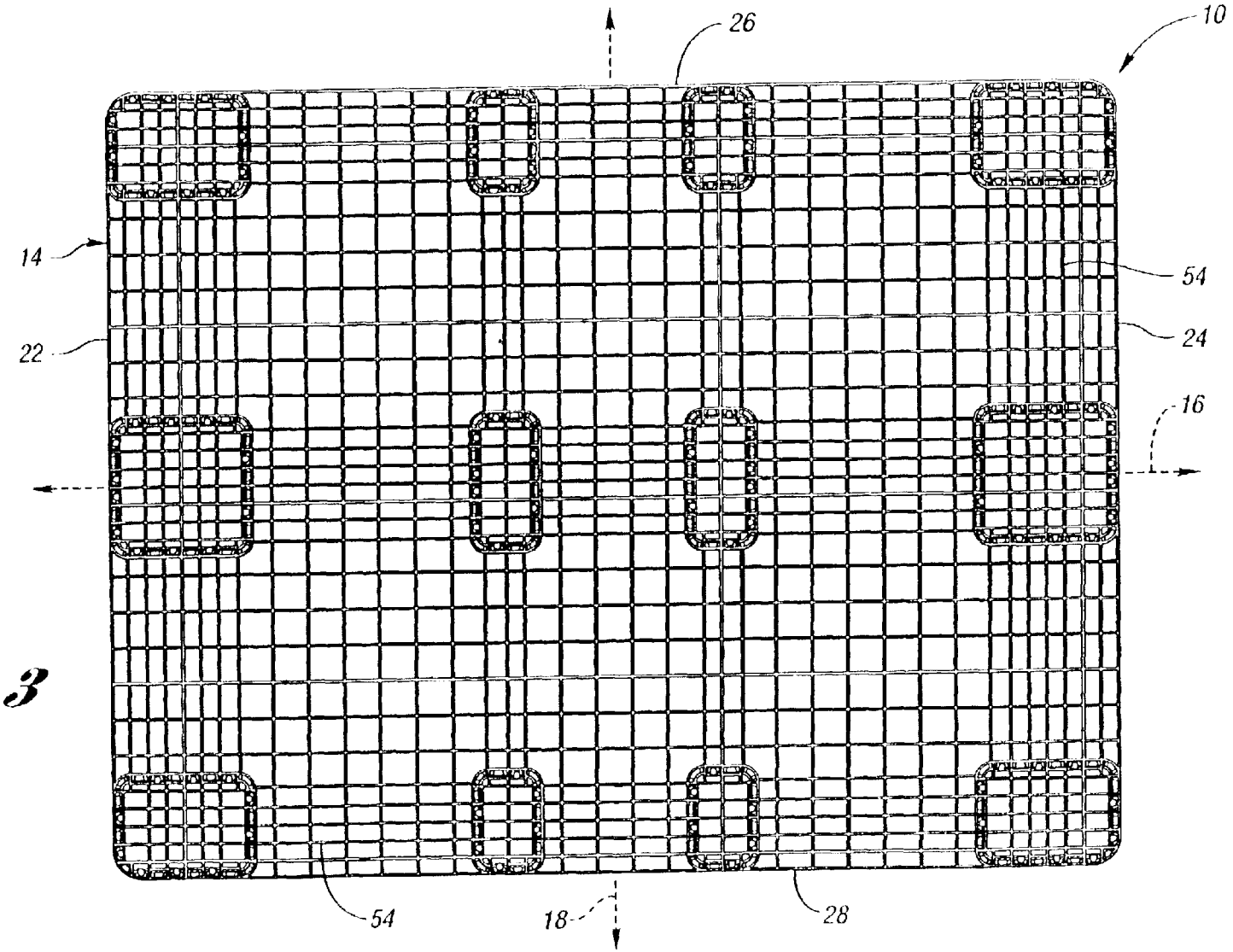
FIG. 3 is a bottom plan view of the pallet of FIG. 1, showing a first embodiment of the lower deck.
Figure 4:
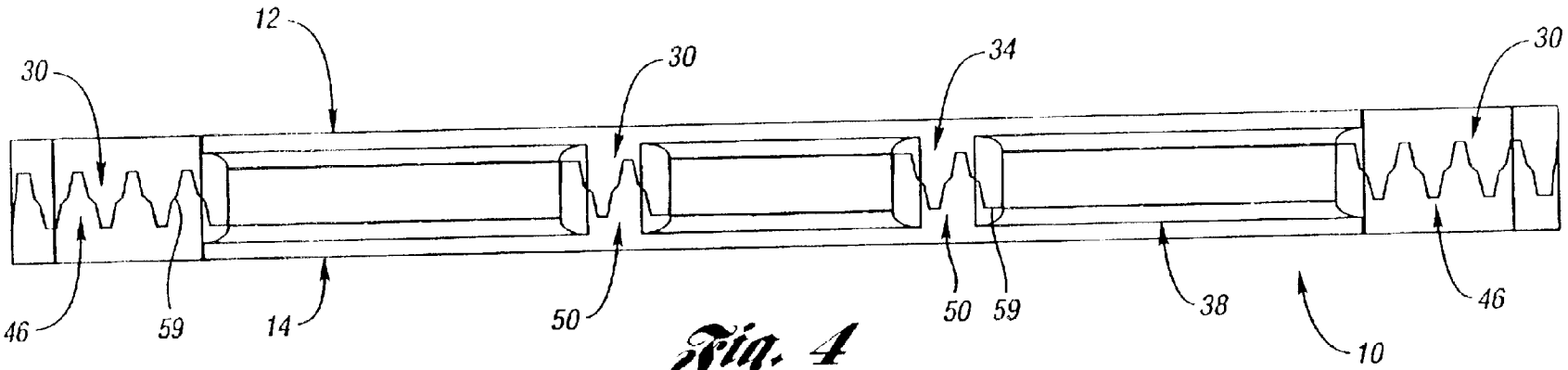
FIG. 4 is a front elevational view of the pallet of FIG. 1, the rear elevational view being a mirror image thereof.
Figure 5:
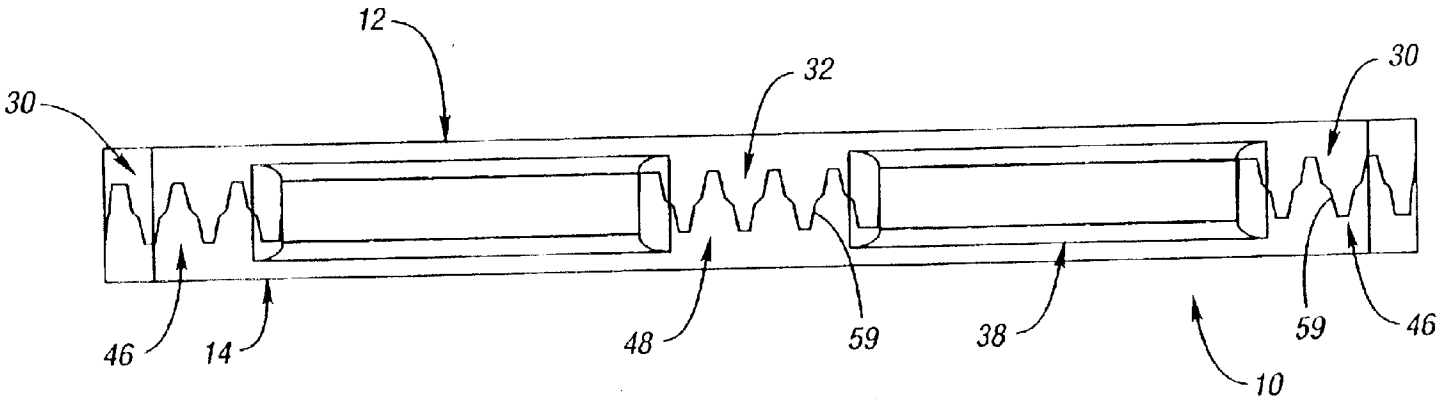
FIG. 5 is a left side elevational view of the pallet of FIG. 1, the right side elevational view being a mirror image thereof.
Figure 10:
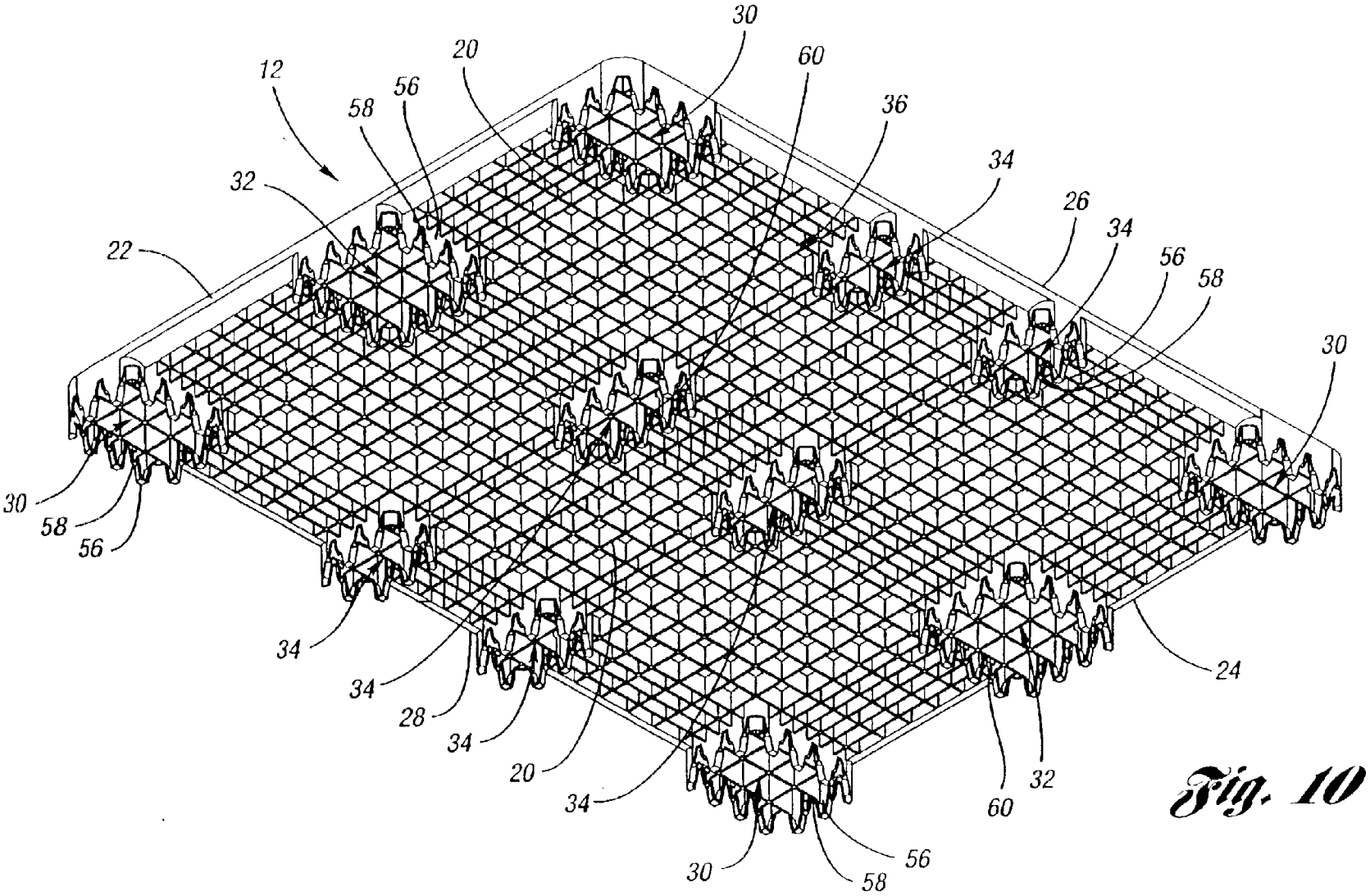
FIG. 10 is a bottom perspective view of the upper deck of the pallet of FIG. 9.

With reference to FIGS. 1–2 and the upper deck perspective view of FIG. 10, ribs 20 in upper deck 12 form an orthogonal pattern which runs parallel and perpendicular to the sides 22, 24, 26, 28 of pallet 10. Ribs 20 form apertures which reduce the weight of upper deck 12 and allow for drainage in the event that pallet 10 becomes wet.

Referring again to FIG. 10, a plurality of mating areas 30, 32, 34 are integrally formed within the bottom surface 36 of upper deck 12. More specifically, at each of the four corners of the upper deck 12, a generally rectangular corner mating area 30 is formed. Along longitudinal axis 16 (see FIG. 2) at the mid-point of the left side 22 and right side 24 of the pallet 10, generally square medial mating areas 32 are formed. In addition, on either side of transverse axis 18 (see FIG. 2), generally rectangular transverse mating areas 34 are formed. Transverse mating areas 34 are located along front side 26 of pallet 10, rear side 28 of pallet 10, and centrally intersecting with longitudinal axis 16. Mating areas 30, 32, 34 preferably have smooth, rounded outside surfaces to prevent damage from the forks of a fork lift or pallet jack.

As described in detail below, mating areas 30 which are disposed in opposite corners have similar configurations, whereas mating areas 30 which are adjacent have complementary configurations. Mating areas 32 also have complementary configurations, as do mating areas 34 which are disposed on opposite sides of transverse axis 18. Of course, while twelve mating areas 30, 32, 34 are depicted herein, any lesser or greater number of mating areas as well as other shapes and configurations of mating areas are fully contemplated in accordance with the present invention. Mating areas 30, 32, 34 are adapted to engage opposed and complementary mating areas 46, 48, 50 which are integrally molded with lower deck 14 as described below.

Figure 9:
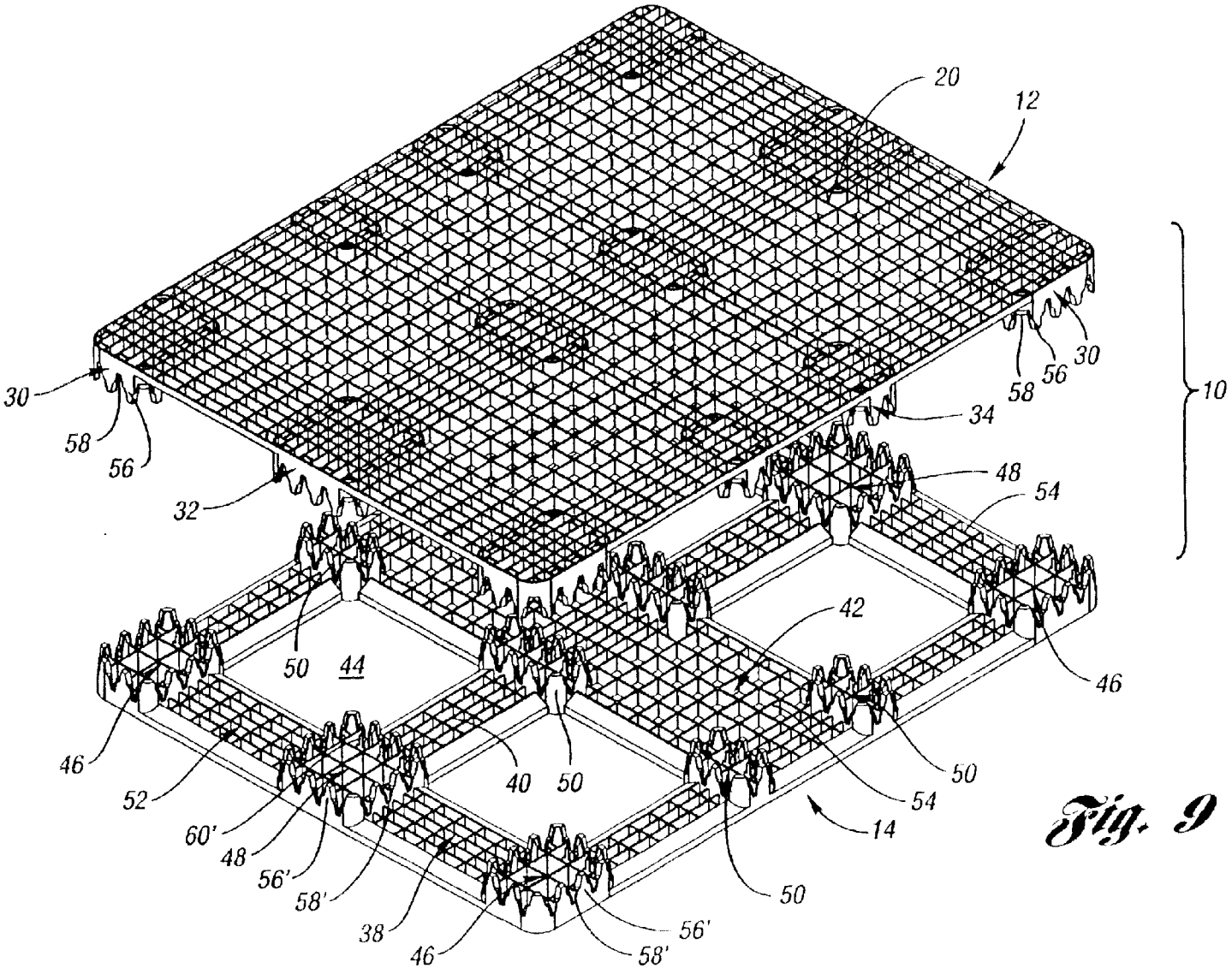
FIG. 9 is a top perspective, exploded view of the pallet of FIG. 1, showing the upper and lower decks aligned for assembly.
Figure 11:
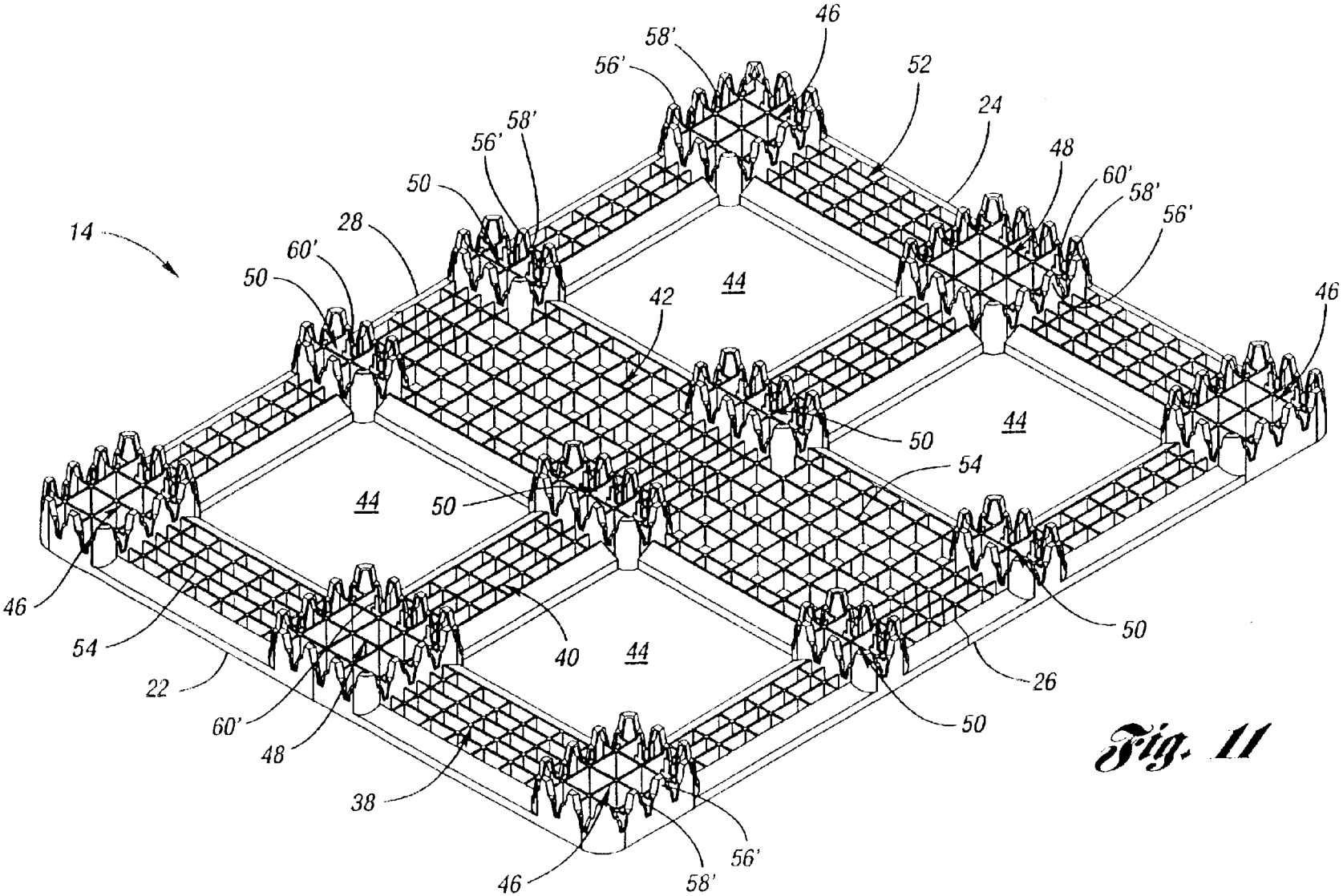
FIG. 11 is a top perspective view of the lower deck of the pallet of FIG. 9.

Referring next to FIGS. 9 and 11, a first embodiment of lower deck 14 is shown. Lower deck 14 has a footprint which substantially matches that of upper deck 12, but differs slightly in structure. Lower deck 14 includes a generally rectangular perimeter portion 38, an integrally formed longitudinal member or rail 40 joined to the perimeter portion 38 at sides 22, 24 of pallet 10 and extending along longitudinal axis 16 (see FIG. 3). In addition, an integrally formed transverse member or rail 42 is joined to the perimeter portion 38 at sides 26, 28 of pallet 10. Transverse rail 42 is also joined with the longitudinal rail 40 and extends along the transverse axis 18 (see FIG. 3). Together, perimeter portion 38, longitudinal rail 40, and transverse rail 42 define four relatively large openings 44 in lower deck 14.

Referring again to FIG. 11, lower deck mating areas 46, 48, 50 corresponding respectively in number and shape to upper deck mating areas 30, 32, 34 are integrally formed with and project upwardly from a top surface 52 of lower deck 14. In the exemplary configuration depicted herein, corner mating areas 46 project from the four corners of perimeter portion 38, medial mating areas 48 project from each end of longitudinal rail 40, and transverse mating areas 50 project from the ends and midpoint of each transverse rail 42 on each side of transverse axis 18 (see FIG. 3). With reference to the assembled pallet views of FIGS. 1 and 4–5, the areas between mating areas 30, 46 and 32, 48 and 34, 50 are regions arranged to receive the forks of a fork lift or pallet jacks.

As best shown in FIG. 11, lower deck 14 has a plurality of reinforcing ribs 54 which provide structural rigidity for the deck 14 and properly distribute the load carried by the upper deck 12 and mating areas 46, 48, 50.

Figure 12:
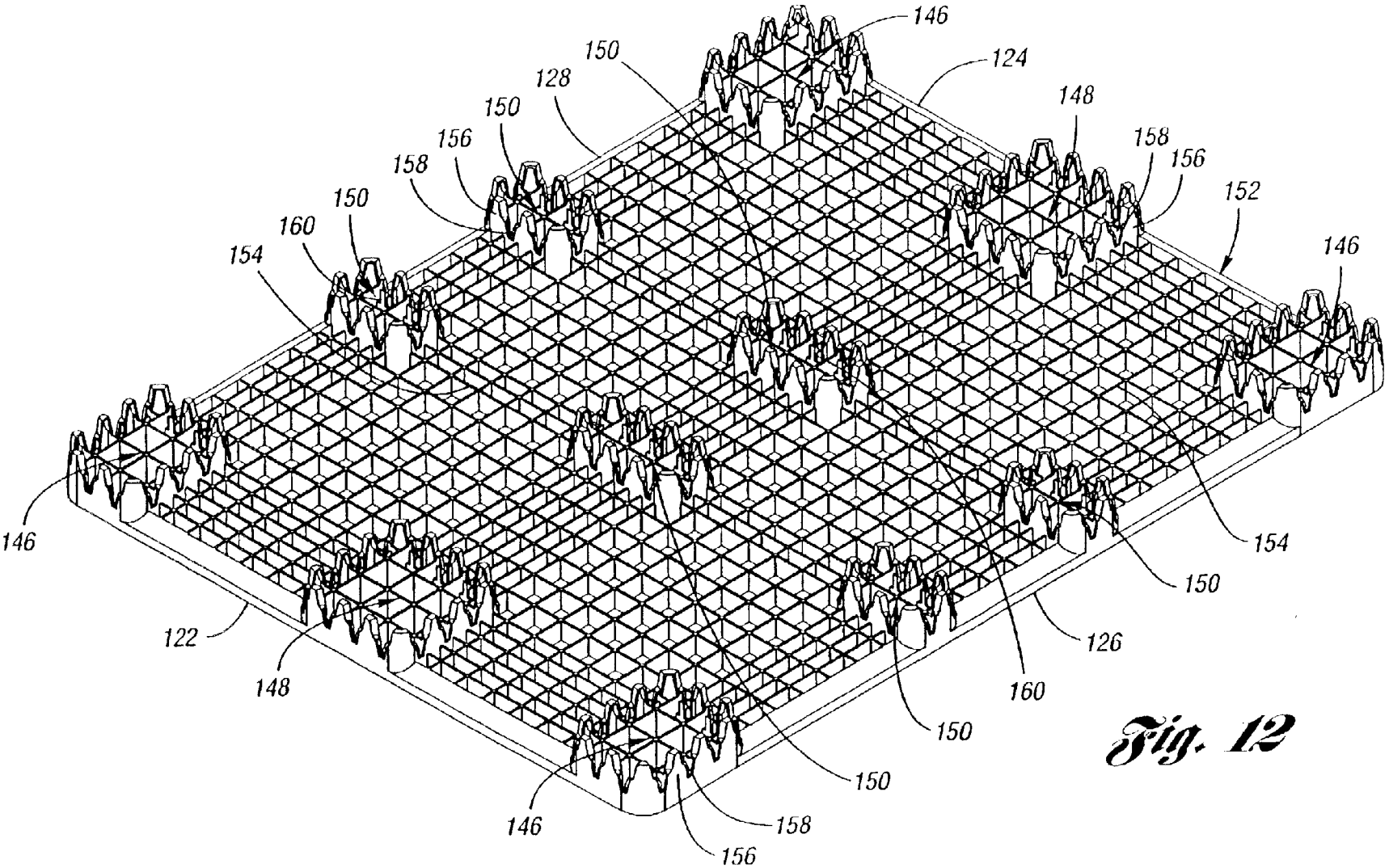
FIG. 12 is a top perspective view of an alternative embodiment of the lower deck.

A second embodiment of lower deck, designated generally by reference numeral 114, is illustrated in the perspective view of FIG. 12. Components of lower deck 114 which are similar to components described previously for upper deck 12 or lower deck 14 have like reference numerals with the addition of a "1" prefix. To construct lower deck 114, mold inserts which define the openings 44 in lower deck 14 are removed, such that in this embodiment upper deck 12 and lower deck 114 have substantially identical configurations. Advantageously, therefore, upper and lower decks 12, 114 are completely reversible and thus can be constructed using the same mold. In contrast to the first embodiment of lower deck 14 described above, in lower deck 114 the area between mating areas 146, 148, 150 is fully spanned by ribs 154 such that lower deck 114 does not include any large open areas.

Therefore, either lower deck 14 or lower deck 114 can be mated with upper deck 12 to form an assembled pallet 10 according to the present invention. Accordingly, while the following description refers only to lower deck 14, it is understood that this description applies equally well to lower deck 114.

Figure 14:
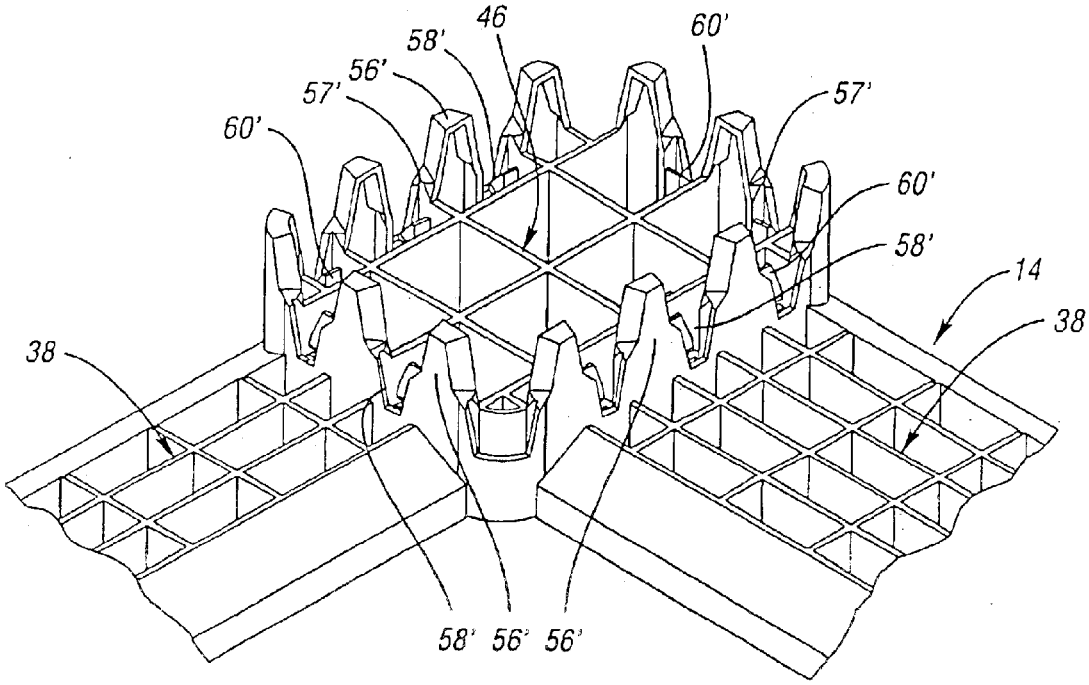
FIG. 14 is an enlarged perspective view of a corner portion of the lower deck shown in FIG. 11.
Figure 13:
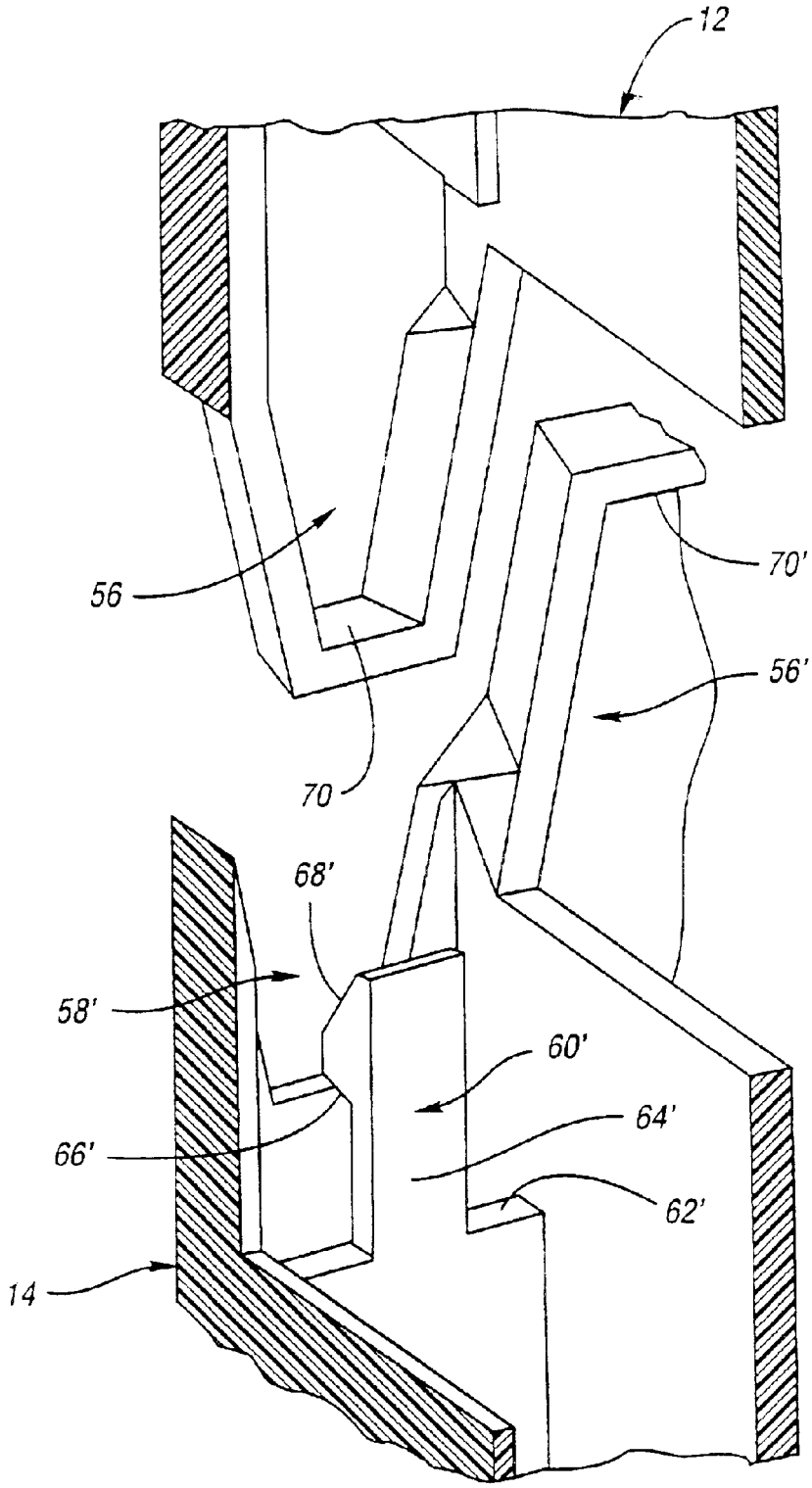
FIG. 13 is a fragmentary perspective view showing a projection of the upper deck prior to engagement with a recess and latch member of the lower deck.

Turning now to FIGS. 10–11 and the enlarged views of FIGS. 13–14, upper deck mating areas 30, 32, 34 and lower deck mating areas 46, 48, 50 each include an alternating configuration of projections 56 and recesses 58. In the drawings as well as the description that follows, reference numerals for projections and recesses located on lower deck 14 are given a prime (') designation. The projections 56 of the upper deck 12 are arranged to be received by the recesses 58' of the lower deck 14, and the projections 56' of the lower deck 14 are arranged to be received by the recesses 58 of the upper deck 12.

As best shown in the enlarged fragmentary view of FIG. 13, opposed projections 56, 56' and recesses 58, 58' are tapered in the z direction generally perpendicular to the plane of the decks 12, 14. In addition, projections 56, 56' and recesses 58, 58' each include faces 57, 57' disposed in the x-y plane generally parallel to the plane of the decks 12, 14, wherein the faces 57, 57' are correspondingly angled. Due to their angle of taper, opposed projections 56, 56' and recesses 58, 58' on decks 12, 14 at first align easily. Once the upper and lower decks 12, 14 are fully seated in an assembled position, projections 56, 56' and recesses 58, 58' mate with a tight interference fit and create an interlock between the upper and lower decks 12, 14 which provides resistance against their disengagement. Furthermore, engagement of the opposed angled faces 57, 57' advantageously restrains transverse movement of the mated projections 56, 56' and recesses 58, 58' along the plane of the decks 12, 14.

As shown in FIGS. 10–11 and 14, projections 56, 56' and recesses 58, 58' are formed along a periphery of each mating area 30, 32, 34, 46, 48, 50. When assembled, this arrangement results in a non-planar parting line 59 between the upper and lower decks 12, 14 (see FIGS. 1 and 4–5). Of course, projections 56, 56' and recesses 58, 58' could also be provided in the interior of each mating area 30, 32, 34, 46, 48, 50 to provide further engagement. While parting line 59 is depicted herein as being somewhat wavy, having a configuration similar to a triangle wave, other non-planar configurations of parting line 59 are fully contemplated according to the present invention. In contrast to conventional pallets having planar parting lines, the non-planar parting line configuration according to the present invention greatly decreases the susceptibility of separation of upper and lower decks 12, 14 due to impact forces applied along the parting line, since stress is distributed outside of a single plane.

Advantageously, the arrangement of projections 56, 56' and recesses 58, 58' within different mating areas 30, 32, 34, 46, 48, 50 of the upper and lower decks 12, 14 is designed to allow versatility in assembling upper and lower decks 12, 14. Specifically, complementary configurations of projections 56, 56' and recesses 58, 58' exist between adjacent corner mating areas 30, 46, between medial mating areas 32, 48, and between adjacent transverse mating areas 34, 50 on opposite sides of transverse axis 18 within each deck 12, 14. Consequently, the arrangement of projections 56 and recesses 58 within mating areas 30, 32, 34 of upper deck 12 is always complementary to the arrangement of projections 56' and recesses 58' within the mating areas 46, 48, 50 of lower deck 14, and this asymmetry leads to reversibility such that upper deck 12 can be placed on lower deck 14 without requiring a particular orientation of the decks 12, 14.

In each of the mating areas 30, 32, 34, 46, 48, 50, there are also a plurality of depending latch members or tabs 60, details of which are shown in FIGS. 10–11 and 14 and best shown in FIG. 13. Each mating area 30, 32, 34, 46, 48, 50 includes a plurality of ribs 62 adjacent to each recess 58, and each latch member 60 is integrally formed with one of the ribs 62 and projects therefrom. Each latch member 60 includes an arm portion 64 which attaches the latch member 60 to the rib 62. The arm portion 64 projects outwardly to form a generally horizontal shoulder portion 66 and terminates in a tapered end portion 68. As above, latch members 60 and their related components which are disposed on lower deck 14 have been given a prime (') designation in the related description and drawings.

By way of example, in the embodiment shown herein each corner mating area 30, 46 includes ten latch members 60, 60' and each medial mating area 32, 48 includes twelve latch members 60, 60'. Transverse mating areas 34, 50 disposed along side 28, 128 and side 26, 126 each include five latch members 60, 60', while transverse mating areas 34, 50 disposed along longitudinal axis 16 each include eight latch members 60, 60'. Of course, other numbers of latch members 60, 60' within mating areas 30, 32, 34, 46, 48, 50 may be utilized in practicing the present invention.

FIG. 9 and the enlarged fragmentary view of FIG. 13 depict how the pallet decks 12, 14 are aligned for assembly. The latch members 60, 60' of one deck 12, 14 are arranged to engage the projections 56, 56' of the other deck 12, 14 such that engagement of the mating areas 30, 32, 34, 46, 48, 50 of the upper and lower decks 12, 14 securely joins the decks in an assembled configuration. Latch members 60, 60' are flexible, such that engagement of opposed mating areas 30, 32, 34, 46, 48, 50 on decks 12, 14 causes the projections 56, 56' to contact the tapered end portions 68, 68' of each latch member 60, 60' and deflect the latch members 60, 60' outwardly from their resting position. As decks 12, 14 are further advanced toward each other, passage of a receiving face 70, 70' of the projection 56, 56' past the tapered portion 68, 68' allows the latch members 60, 60' to spring inwardly to return to their rest position such that the shoulder portions 66, 66' of the latch members 60, 60' engage the receiving faces 70, 70' of the projections 56, 56'.

Figure 6:
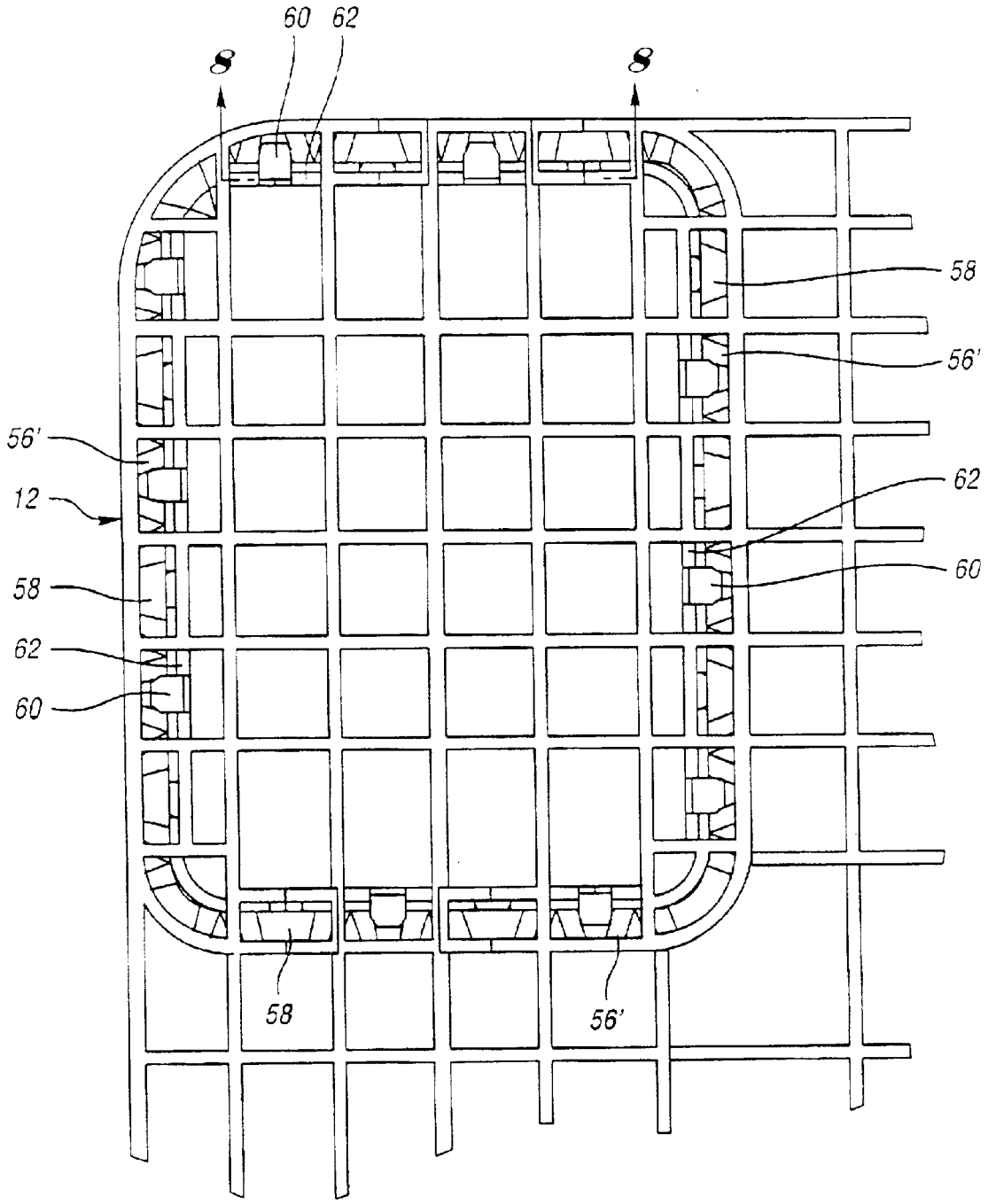
FIG. 6 is an enlarged top plan view of a corner portion of the pallet shown in FIG. 1.
Figure 7:
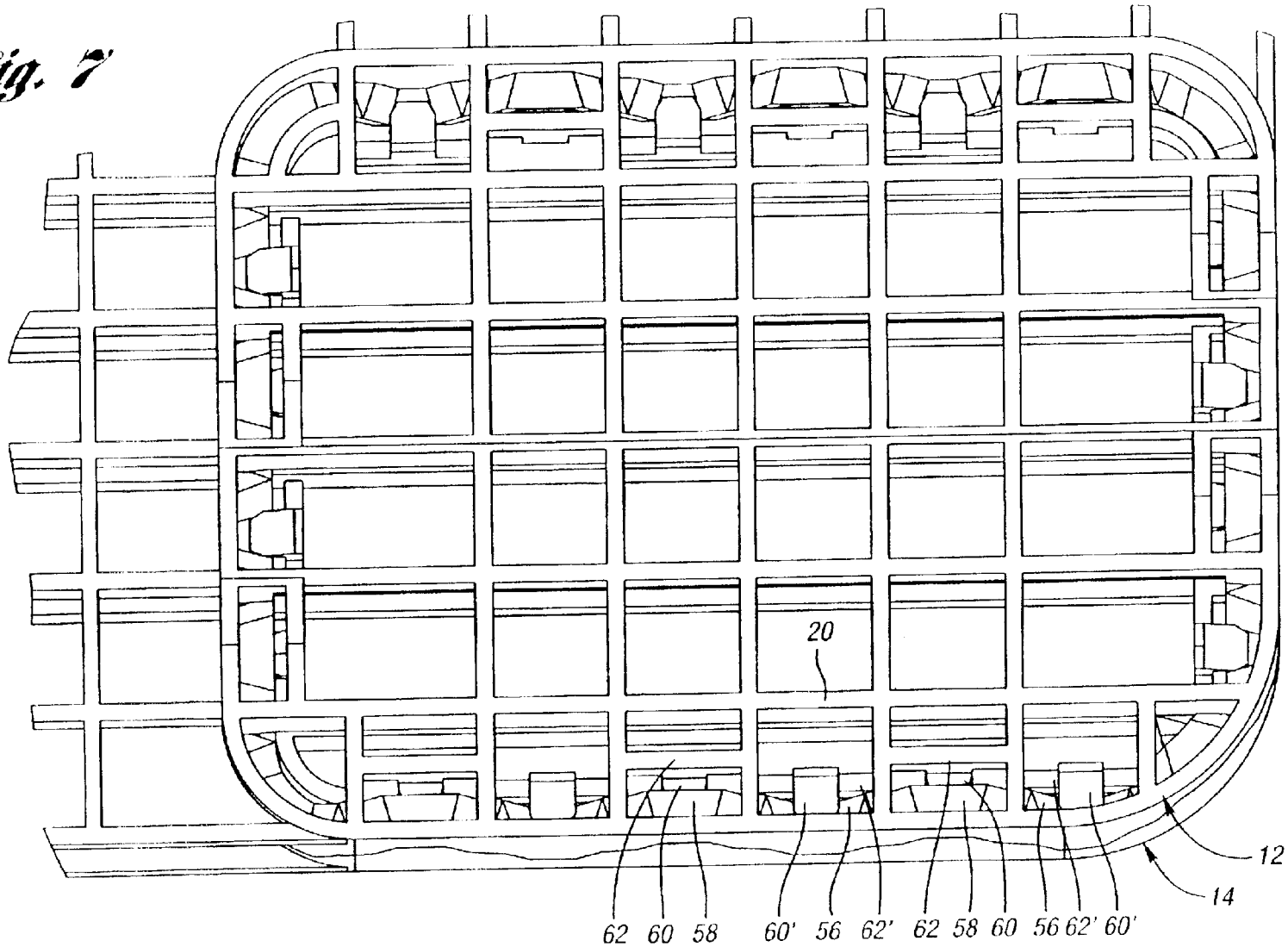
FIG. 7 is an enlarged perspective view of the corner portion shown in FIG. 6.
Figure 8:
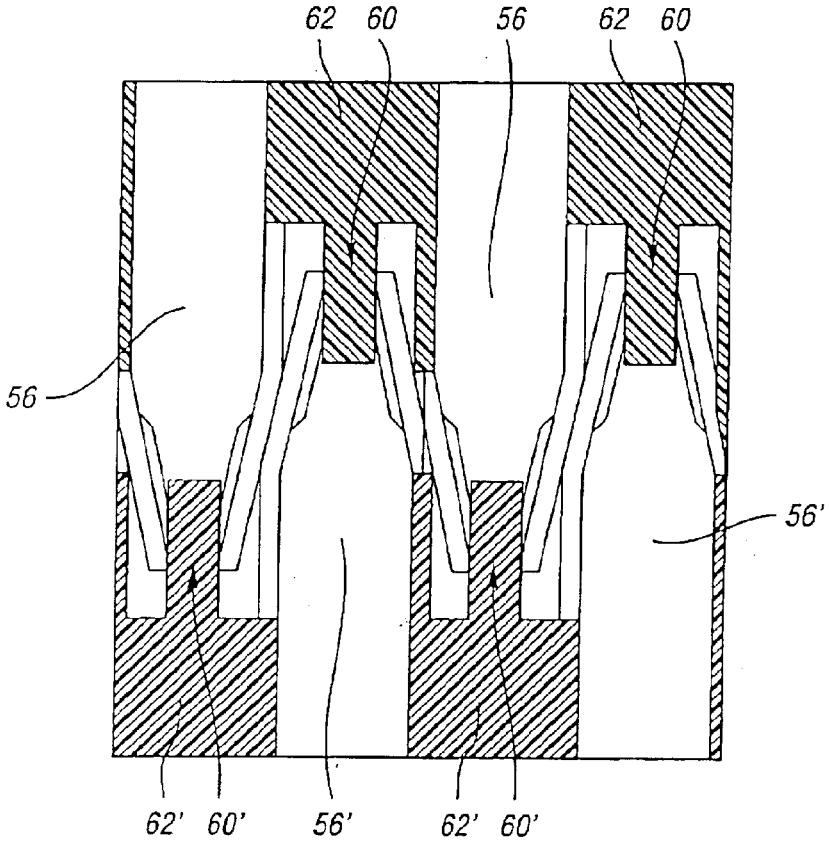
FIG. 8 is a cross-sectional view taken along line 8—8 of FIG. 6 showing the upper and lower decks in an assembled configuration.

With reference now to FIGS. 6–7 and the cross-sectional view of FIG. 8, corresponding mating areas 30, 32, 34, 46, 48, 50 of the assembled upper and lower decks 12, 14 include an alternating arrangement of latch members 60 of the upper deck 12 engaged with projections 56' of the lower deck 14 and latch members 60' of the lower deck 14 engaged with projections 56 of the upper deck 12. Engagement surfaces defined by the location of engagement of latch members 60 of the upper deck 12 and projections 56' of the lower deck 14, more specifically the engagement location of shoulder portions 66, 66' and receiving faces 70, 70' are not co-planar with engagement surfaces defined by the location of engagement of latch members 60' of the lower deck 14 and projections 56 of the upper deck 12. Since the engagement surfaces do not all lie in the same plane, improved protection is provided against separation of the pallet decks 12, 14 as a result of lateral impact. Separation of the pallet decks 12, 14 is further countered by having latch members 60, 60' projecting from each of the upper and lower decks 12, 14 since the latch members 60, 60' provide resistance to separation in either direction.

Engagement of each of the mating areas 30, 32, 34 of upper deck 12 with corresponding mating areas 46, 48, 50 of lower deck 14 is accomplished generally simultaneously. Since each engaged mating area 30, 32, 34, 46, 48, 50 includes multiple projections 56, 56' tightly fit with corresponding recesses 58, 58' as well as multiple latch members 60, 60' engaged with corresponding projections 56, 56', a secure connection between upper and lower decks 12, 14 is provided. Furthermore, due to the configuration of the projections 56, 56' and recesses 58, 58', a non-planar parting line 59 (see FIGS. 1 and 4–5) is created which greatly reduces the susceptibility of separation of the pallet decks 12, 14 during use.

While a rectangular pallet 10 has been illustrated and described in the preferred embodiment, other shapes, e.g., square, are fully capable of embodying the features of the invention. The number and shapes of the mating areas 30, 32, 34, 46, 48, 50 also may vary from those shown.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pallet, comprising:

spaced first and second decks; and a plurality of opposed mating areas formed in the first and second decks, each mating area including alternating projections and recesses, the projections having a shape generally complementary to the shape of the recesses, wherein the projections of the first deck are arranged to be received by the recesses of the second deck and the projections of the second deck are arranged to be received by the recesses of the first deck, each mating area further including at least one latch member extending therefrom, wherein the latch members of one deck are arranged to engage the projections of the other deck such that engagement of the mating areas of the first and second decks securely joins the decks in an assembled configuration.

2. The pallet according to claim 1, wherein engagement of the projections and recesses results in a non-planar parting line between the assembled first and second decks.

3. The pallet according to claim 1, wherein the projections and recesses of each deck are tapered to mate with an interference fit.

4. The pallet according to claim 1, wherein the projections and recesses of each deck include angled faces which engage to restrain transverse movement of the assembled decks.

5. The pallet according to claim 1, wherein when the decks are in the assembled configuration, corresponding mating areas of the first and second decks include an alternating arrangement of latch members of the first deck engaged with projections of the second deck and latch members of the second deck engaged with projections of the first deck.

6. The pallet according to claim 1, wherein engagement surfaces defined by the location of engagement of latch members of the first deck and projections of the second deck are not co-planar with engagement surfaces defined by the location of engagement of latch members of the second deck and projections of the first deck.

7. The pallet according to claim 6, wherein each projection includes a receiving face arranged to engage the shoulder portion of one latch member.

8. The pallet according to claim 1, wherein each latch member includes an arm portion which projects outwardly from the mating area, a generally horizontal shoulder portion connected to the arm portion, and a tapered end portion connected to the shoulder portion.

9. The pallet according to claim 7, wherein the latch member is flexible, such that engagement of the opposed mating areas causes the projections to contact the tapered end portions of each latch member and deflect the latch members outwardly from their resting position, wherein passage of the receiving face past the tapered portion allows the latch members to return to their rest position such that the shoulder portions of the latch members engage the receiving faces of the projections.

10. The pallet according to claim 1, wherein the pallet is constructed from a plastic material, and the first and second decks have reversible configurations.

11. A pallet, comprising:

a lower deck having a plurality of lower deck mating areas; and an upper deck spaced from and overlying the lower deck, the upper deck having a plurality of upper deck mating areas complementary to the lower deck mating areas, wherein each of the lower deck and upper deck mating areas includes an alternating arrangement of projections and recesses, wherein during assembly of the upper and lower decks, the projections of the lower deck are arranged to be securely received by the recesses of the upper deck and the projections of the upper deck are arranged to be securely received by the recesses of the lower deck, resulting in a non-planar parting line between the upper and lower decks on external surfaces of the mating areas.

12. The pallet according to claim 11, wherein the projections and recesses of each deck are tapered to mate with an interference fit, and wherein the projections and recesses of each deck include angled faces which engage to restrain transverse movement of the assembled decks.

13. The pallet according to claim 11, wherein each of the lower deck and upper deck mating areas further includes at least one latch member extending therefrom, wherein the latch members of one deck are arranged to engage the projections of the other deck such that engagement of the lower deck and upper deck mating areas securely joins the decks in an assembled configuration.

14. The pallet according to claim 13, wherein when the decks are in the assembled configuration, corresponding mating areas of the upper and lower decks include an alternating arrangement of latch members of the lower deck engaged with projections of the upper deck and latch members of the upper deck engaged with projections of the lower deck.

15. The pallet according to claim 13, wherein engagement surfaces defined by the location of engagement of latch members of the first deck and projections of the second deck are not co-planar with engagement surfaces defined by the location of engagement of latch members of the second deck and projections of the first deck.

16. The pallet according to claim 13, wherein each latch member includes an arm portion which projects outwardly from the mating area, a generally horizontal shoulder portion connected to the arm portion, and a tapered end portion connected to the shoulder portion, and each projection includes a receiving face arranged to engage the shoulder portion of one latch member.

17. The pallet according to claim 16, wherein the latch member is flexible, such that engagement of the corresponding lower deck and upper deck mating areas causes the projections to contact the tapered end portions of each latch member and deflect the latch members outwardly from their resting position, wherein passage of the receiving face past the tapered portion allows the latch members to return to their rest position such that the shoulder portions of the latch members engage the receiving faces of the projections.

18. The pallet according to claim 11, wherein the upper and lower deck mating areas include corner mating areas disposed in the corner of each deck, medial mating areas disposed at both ends of a longitudinal axis of the pallet, and transverse mating areas disposed along either side of a transverse axis of the pallet, wherein complementary configurations of projections and recesses exist between adjacent corner mating areas, between the medial mating areas, and between adjacent transverse mating areas on opposite sides of the transverse axis within each deck.

19. A two-piece plastic pallet, comprising:

spaced upper and lower decks; and a plurality of opposed mating areas formed in the upper and lower decks, each mating area including alternating projections and recesses and a plurality of latch members extending therefrom, wherein each projection includes angled faces on opposed sides thereof and each recess includes angled faces on opposed sides thereof, the angled faces of the projections engaging the angled faces of the recesses to restrain transverse movement of the assembled decks, wherein during assembly of the upper and lower decks, engagement of the corresponding upper deck and lower deck mating areas causes the projections of the lower deck to be received by the recesses of the upper deck and the projections of the upper deck to be received by the recesses of the lower deck, resulting in a non-planar parting line between the upper and lower decks, and wherein the latch members of one deck are arranged to engage the projections of the other deck such that when the decks are in an assembled configuration, corresponding mating areas of the upper and lower decks include an alternating arrangement of latch members of the upper deck engaged with projections of the lower deck and latch members of the lower deck engaged with projections of the upper deck.

20. A pallet, comprising:

an upper deck;

a lower deck spaced from the upper deck, the upper and lower decks having reversible configurations; and a plurality of opposed mating areas formed in the upper and lower decks, each mating area including alternating projections and recesses disposed along a periphery of each mating area, wherein the projections of the upper deck are arranged to be received by the recesses of the lower deck and the projections of the lower deck are arranged to be received by the recesses of the upper deck, each mating area further including a plurality of latch members extending therefrom, wherein the latch members of one deck are arranged to engage the projections of the other deck such that engagement of the mating areas of the upper and lower decks securely joins the decks in an assembled configuration.

21. The pallet according to claim 20, wherein engagement of the projections and recesses results in a non-planar parting line between the assembled upper and lower decks.

22. The pallet according to claim 20, wherein the projections and recesses of each deck are tapered to mate with an interference fit, and wherein the projections and recesses of each deck include angled faces which engage to restrain transverse movement of the assembled decks.

23. The pallet according to claim 20, wherein when the decks are in the assembled configuration, corresponding mating areas of the upper and lower decks include an alternating arrangement of latch members of the upper deck engaged with projections of the lower deck and latch members of the lower deck engaged with projections of the upper deck.

24. The pallet according to claim 20, wherein engagement surfaces defined by the location of engagement of latch members of the first deck and projections of the second deck are not co-planar with engagement surfaces defined by the location of engagement of latch members of the second deck and projections of the first deck.

25. The pallet according to claim 20, wherein each latch member includes an arm portion which projects outwardly from the mating area, a generally horizontal shoulder portion connected to the arm portion, and a tapered end portion connected to the shoulder portion, and each projection includes a receiving face arranged to engage the shoulder portion of one latch member.

26. The pallet according to claim 20, Wherein the latch member is flexible, such that engagement of the opposed mating areas causes the projections to contact the tapered end portions of each latch member and deflect the latch members outwardly from their resting position, wherein passage of the receiving face past the tapered portion allows the latch members to return to their rest position such that the shoulder portions of the latch members engage the receiving faces of the projections.

27. The pallet according to claim 20, wherein the upper and lower deck mating areas include corner mating areas disposed in the corner of each deck, medial mating areas disposed at both ends of a longitudinal axis of the pallet, and transverse mating areas disposed along either side of a transverse axis of the pallet, wherein complementary configurations of projections and recesses exist between adjacent corner mating areas, between the medial mating areas, and between adjacent transverse mating areas on opposite sides of the transverse axis within each deck.

28. A pallet, comprising:

an upper deck;

a lower deck spaced from the upper deck;

a plurality of alternating projections and recesses disposed along a periphery of each deck, wherein the projections of the upper deck are arranged to be received by the recesses of the lower deck and the projections of the lower deck are arranged to be received by the recesses of the upper deck such that the projections and recesses remain visible along the periphery of the deck; and a plurality of latch members extending from each deck adjacent the recesses, wherein the latch members of one deck are arranged to engage the projections of the other deck such that engagement of the upper and lower decks securely joins the decks in an assembled configuration.

29. A pallet, comprising:

spaced first and second decks; and a plurality of opposed mating areas formed in the first and second decks, each mating area including alternating projections and recesses, each projection having a periphery, wherein the projections of the first deck are arranged to be received by the recesses of the second deck and engaged by the recesses on a majority of the periphery thereof, and the projections of the second deck are arranged to be received by the recesses of the first deck and engaged by the recesses on a majority of the periphery thereof, each mating area further including at least one latch member extending therefrom, wherein the latch members of one deck are arranged to engage the projections of the other deck such that engagement of the mating areas of the first and second decks securely joins the decks in an assembled configuration.

* * * * *